US011998790B2

(12) United States Patent
Bou-Rabee

(10) Patent No.: US 11,998,790 B2
(45) **Date of Patent: *Jun. 4, 2024**

(54) EXERCISE APPARATUS INCLUDING WEIGHT BAR

(71) Applicant: Khalid Bou-Rabee, New York, NY (US)

(72) Inventor: Khalid Bou-Rabee, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/131,799

(22) Filed: Apr. 6, 2023

(65) Prior Publication Data

US 2023/0241444 A1 Aug. 3, 2023

Related U.S. Application Data

(63) Continuation of application No. 17/515,341, filed on Oct. 29, 2021, now Pat. No. 11,648,436.

(60) Provisional application No. 63/214,192, filed on Jun. 23, 2021, provisional application No. 63/116,714, filed on Nov. 20, 2020, provisional application No. 63/107,065, filed on Oct. 29, 2020.

(51) Int. Cl.

| | |
|---|---|
| ***A63B 21/072*** | (2006.01) |
| ***A63B 21/00*** | (2006.01) |
| ***A63B 21/04*** | (2006.01) |
| ***A63B 21/055*** | (2006.01) |

(52) U.S. Cl.

CPC ..... *A63B 21/072* (2013.01); *A63B 21/0442* (2013.01); *A63B 21/0552* (2013.01); *A63B 21/154* (2013.01); *A63B 21/4034* (2015.10); *A63B 2208/0204* (2013.01)

(58) Field of Classification Search

CPC ..... A63B 21/072; A63B 21/0442; A63B 21/0552; A63B 21/154; A63B 21/4034; A63B 2208/0204; A63B 2071/027; A63B 21/0414; A63B 21/4043; A63B 23/03525; A63B 23/1209; A63B 21/4035

See application file for complete search history.

(56) References Cited

U.S. PATENT DOCUMENTS

| | | | |
|---|---|---|---|
| 3,785,644 | A | 1/1974 | Bradley |
| 4,235,439 | A | 11/1980 | De Donno |
| 4,479,647 | A | 10/1984 | Smith |
| 5,125,649 | A | 6/1992 | Fuller |
| 5,190,512 | A | 3/1993 | Curran |
| 5,480,369 | A | 1/1996 | Dudley |
| 5,846,170 | A | 12/1998 | Ho |
| 6,022,297 | A | 2/2000 | DeJesus |
| 6,612,170 | B2 | 9/2003 | Brown |
| 6,790,163 | B1 | 9/2004 | Van De Laarschot |
| 7,090,627 | B1 | 8/2006 | Walker |
| 7,357,762 | B1 | 4/2008 | Terry |
| 7,465,259 | B2 | 12/2008 | Mok |
| 7,918,773 | B2 | 4/2011 | Brennan |
| 8,348,814 | B1 | 1/2013 | Hinds |

(Continued)

*Primary Examiner* — Andrew S Lo

(74) *Attorney, Agent, or Firm* — Jon E. Gordon; Haug Partners LLP

(57) ABSTRACT

An apparatus is provided for use in resistance training. The apparatus may include a bar with pulley hubs on its ends. The apparatus may further include two slings, each including connectors and a rigid, straight or arc-shaped bar. The slings may be suspended from the pulley hubs and support an elastic band, which may provide resistance during exercise. A footplate may also be provided to hold part of the band to the floor during use.

8 Claims, 8 Drawing Sheets

(56) References Cited

U.S. PATENT DOCUMENTS

| | | | |
|---|---|---|---|
| 8,845,499 | B1 | 9/2014 | Boatwright |
| 9,254,405 | B1 | 2/2016 | Marji |
| 9,775,764 | B1 | 10/2017 | Rill |
| 10,022,578 | B2 | 7/2018 | Kelly |
| 10,143,880 | B1 | 12/2018 | Boatwright |
| 10,843,029 | B2 | 11/2020 | Boatwright |
| D914,813 | S | 3/2021 | Li |
| 11,033,774 | B1 | 6/2021 | Clarke |
| 2009/0275449 | A1 | 11/2009 | Terry |
| 2017/0182348 | A1 | 6/2017 | Bertolutti |
| 2017/0209730 | A1 | 7/2017 | Sise |
| 2018/0214729 | A1 | 8/2018 | Rubin |
| 2021/0154522 | A1 | 5/2021 | Wu |
| 2021/0339078 | A1 | 11/2021 | Akeel |

EXERCISE APPARATUS INCLUDING WEIGHT BAR

CROSS REFERENCE TO RELATED APPLICATIONS

This application is a continuation of U.S. patent application Ser. No. 17/515,341, filed 29 Oct. 2021 and titled "Exercise Apparatus Including Weight Bar"; which claims the benefit of Provisional U.S. Patent Application No. 63/107,065, filed 29 Oct. 2020 and titled "Weight Bar"; Provisional U.S. Patent Application No. 63/116,714, filed 20 Nov. 2020 and titled "Weight Bar"; and Provisional U.S. Patent Application No. 63/214,192, filed 23 Jun. 2021 and titled "Weight Bar and Footplate", all of which are incorporated herein by reference.

BACKGROUND

Resistance training is a form of physical exercise that typically involves using muscular strength to repeatedly move an object against a force opposing the movement. Weight training is a common form of resistance training. Weights are bulky and heavy, however, which can make it hard to keep and use a weight training apparatus at home.

Elastic bands can be used for resistance training. For example, an elastic band can be affixed to or supported by, e.g., a bar resembling one used in weight training. The bar and band are configured such that the exercise moves the bar in a direction causing the band to stretch, causing the band to exert a force on the bar opposing the movement.

Existing apparatus for resistance training with elastic bands has shortcomings. One such shortcoming is that changing the resistance level for any particular exercise my require using a different band or bands. An apparatus supporting a comprehensive program of resistance training may thus require an inconvenient number of bands to allow sufficient variation in resistance levels.

Another shortcoming is that existing means for attaching elastic bands to bars are unsatisfactory. Simply looping ends of an elastic band over the ends of a weight bar is insecure and typically unbalanced.

A bar may therefore have, e.g., hooks on its ends. Hooks may not fully secure a band in place during a movement, however; and sudden separation of a band from a bar may lead to a sudden unintended movement of the bar, possibly causing bodily injury or property damage. Hooks may also lead to asymmetrical loading of the bar, or, relatedly, to the band exerting its force in a direction that is not exactly as expected by the user, which can similarly lead to injury or damage, or even just inefficient or uncomfortable exercise. The band may also, e.g., bunch up in the places supported by the hooks, which may in turn lead to undue wear on the band, possibly leading to its premature failure.

Hooks have other disadvantages when used in this context. For example, the geometry means that more metal must be used to support a certain weight because the weight is supported from only one side.

There is therefore a need for an improved way of coupling an elastic band or bands to a bar for use in resistance training.

BRIEF SUMMARY OF THE INVENTION

Embodiments of the invention relate to exercise apparatus for use in resistance training. The apparatus provides a stable and secure support for an elastic band as the element providing resistance against the exercise being performed.

According to embodiments of the invention, an apparatus is provided for use in resistance training. The apparatus comprises an elongated bar, a first pulley hub disposed near a first end of the bar, and a second pulley hub disposed near a second end of the bar, the second end being opposed to the first end. The apparatus also comprises two slings, each sling comprising an arm and two connectors extending from a respective end of the arm and terminating in a loop such that, for each sling, the two loops can be retained by one of the pulley hubs in a manner such that the sling is capable of supporting a resistance band during resistance exercise using the bar.

In an embodiment, each pulley hub is affixed to the bar in a manner preventing movement of the pulley hub relative to the bar. Alternatively, in an embodiment, each pulley hub is secured to the bar in a manner substantially preventing the pulley hub from moving lengthwise relative to the bar while allowing free rotation of the hub around the bar.

In an embodiment, each arm is a bar having two ends, each end having a hole passing through the bar in a transverse direction. In a further embodiment, each arm is substantially straight. In an alternative further embodiment, each arm is in the shape of an arc.

In an embodiment, each connector is a flexible cord. In a further embodiment, each connector is a flexible cord having its ends knotted together forming a bight in the cord such that the bight can pass through one of the holes in one of the arms but the knot cannot.

In an embodiment, the apparatus comprises an elastic resistance band. In a further embodiment, the apparatus comprises a footplate, the footplate having an upper side and a lower side opposed to the upper side, the lower side having one or more channels for retaining a resistance band.

DETAILED DESCRIPTION OF PREFERRED EMBODIMENTS

Figure 1:
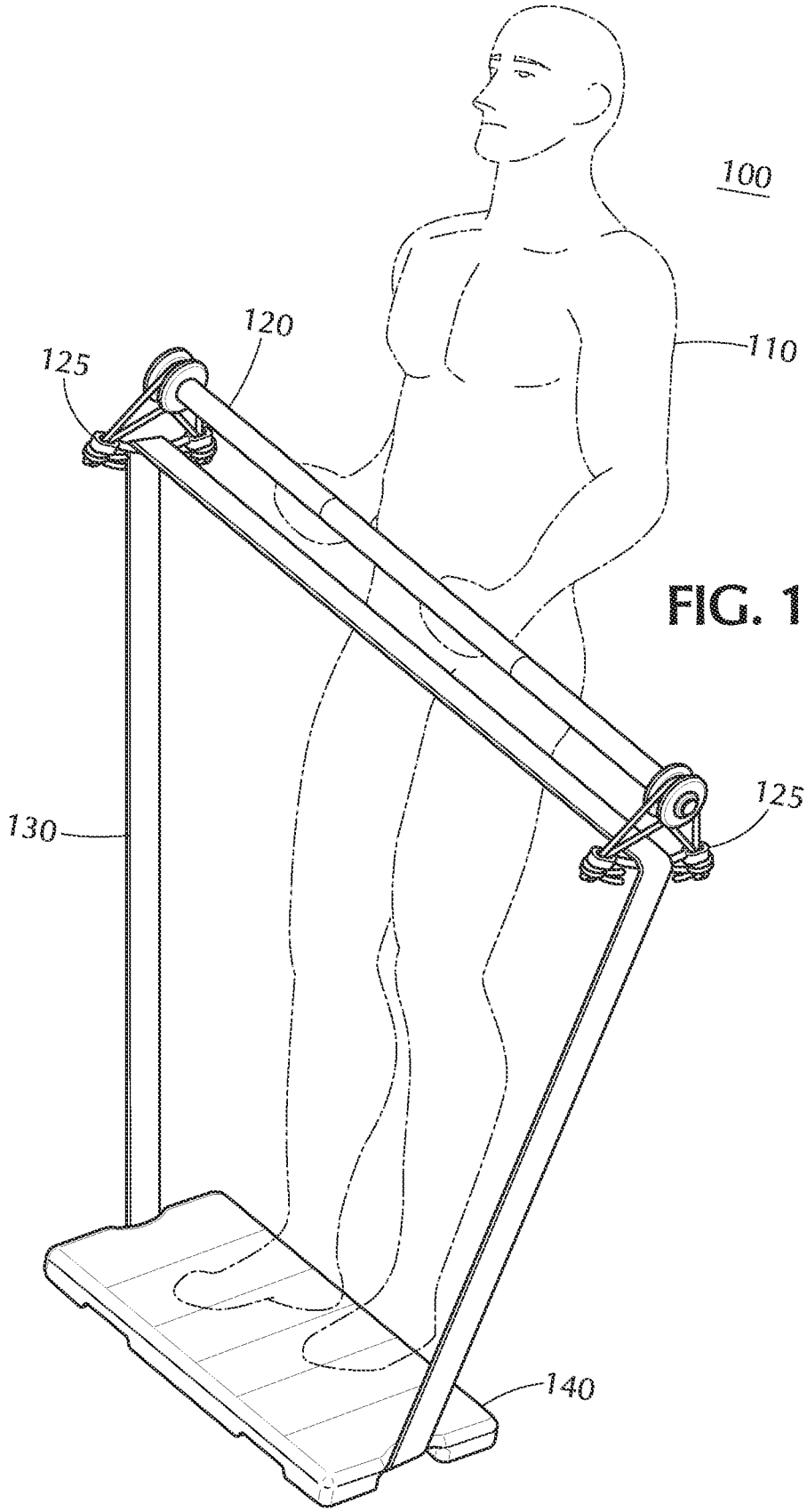
FIG. 1 depicts a person using an apparatus according to an embodiment of the invention.

FIG. 1 depicts an apparatus 100 in use by a person 110 according to an embodiment of the invention. (The depiction of a person in FIG. 1 is meant only to illustrate the apparatus and its functions according to embodiments of the invention. Embodiments of the invention may include, e.g., devices and/or apparatus intended for use by persons and/or methods of use of such devices and/or apparatus by persons, but they do not encompass a human organism.)

Figure 2:
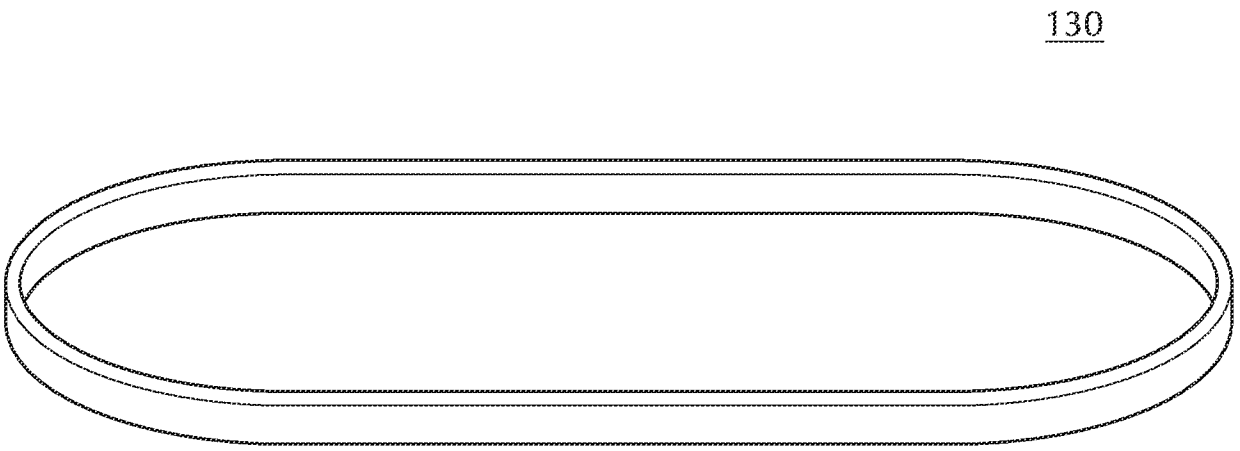
FIG. 2 depicts an elastic band such as may be used in connection with embodiments of the invention.

In an embodiment such as FIG. 1 depicts, the apparatus 100 includes a weight bar 120. The weight bar 120 supports slings 125 that in turn support an elastic band 130. In an embodiment of the invention, the elastic band 130 is a continuous loop, e.g., as FIG. 2 depicts, but it will be appreciated that other configurations are possible. For example, an elastic band in connection with an embodiment of the invention may be a straight band with looped ends (not pictured), which may be affixed, e.g., to an object to provide resistance to movement of a bar.

Returning to FIG. 1, the elastic band is threaded through features of the weight bar 120 and loops below a footplate 140. As depicted, the weight of the user 110 standing on the footplate 140 traps the band 130 below the footplate 140. As a consequence, raising the bar 120 stretches the band 130, increasing the force resisting the movement. Lowering the bar 120 reduces the stretch and thus the force exerted by the band 130.

Figure 3:
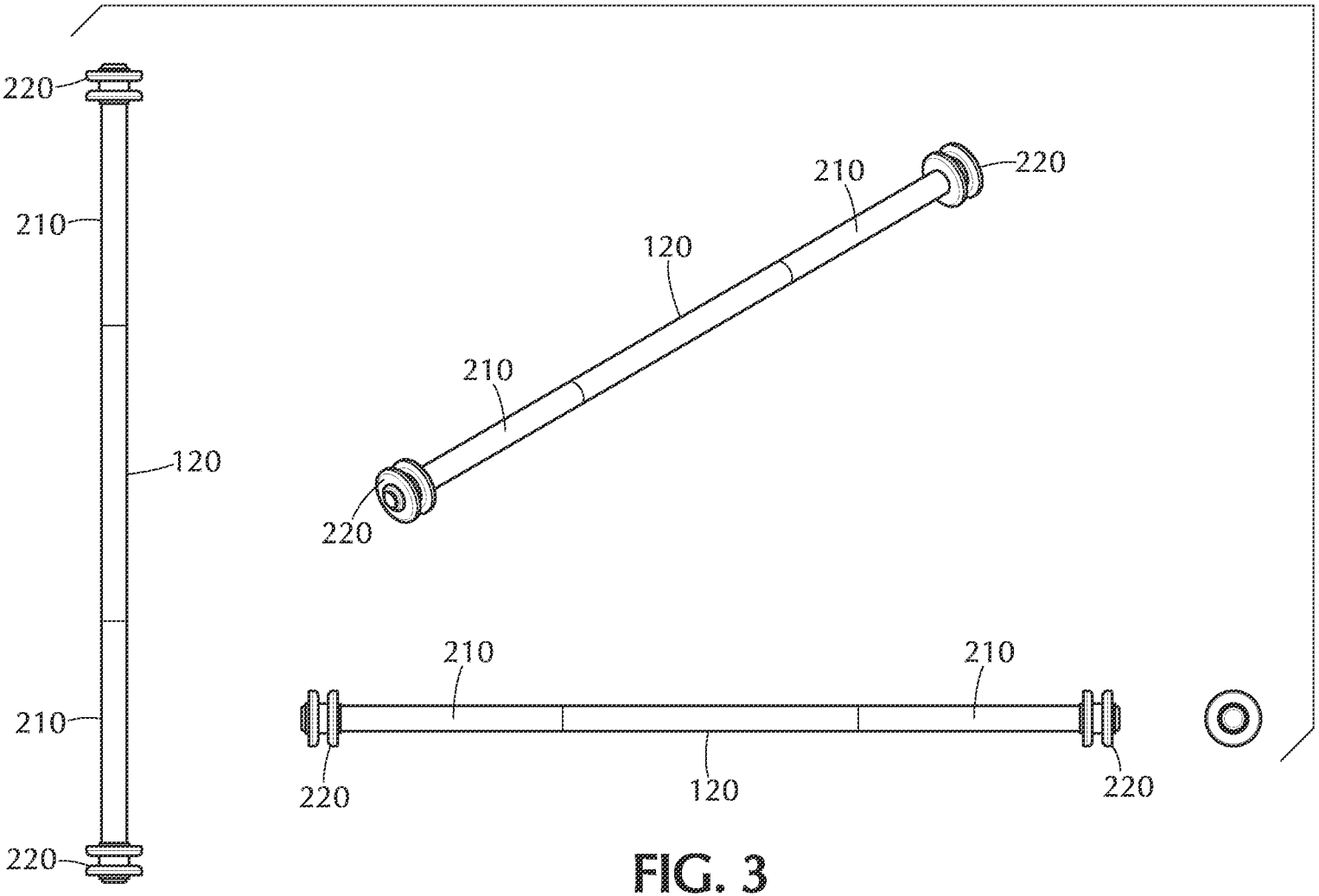
FIG. 3 depicts a weight bar according to an embodiment of the invention.

FIG. 3 depicts an example of a weight bar 120 according to an embodiment of the invention. A weight bar 120 may be of any dimensions and made of any material consistent with its intended use. For example, in one embodiment of the invention, a weight bar 120 may be a solid bar of steel, with a substantially circular cross-section that is substantially uniform throughout the length of the bar. The bar 120, for example, may be three to four feet long and one inch thick.

A weight bar 120 may be considered substantially circular for this purpose if it does not deviate from circularity to a degree that is perceptible during ordinary use. A bar may be considered substantially circular and substantially uniform despite the presence, in embodiments, of, e.g., knurling, tape, or other treatment to enhance grip applied, e.g., to discontinuous regions 210 of the bar.

Other shapes and dimensions are possible if desired. For example, a bar designed to handle, e.g., like a dumbbell, may be nine inches long. The bar 120 depicted in FIGS. 1-3 is straight, but other bars (not pictured) may depart from this shape if desired. For example, barbells (not pictured) with a shape suited to bicep curls are known to the art, and a weight bar according to an embodiment of the invention may have a shape similar to such a barbell.

Figure 4:
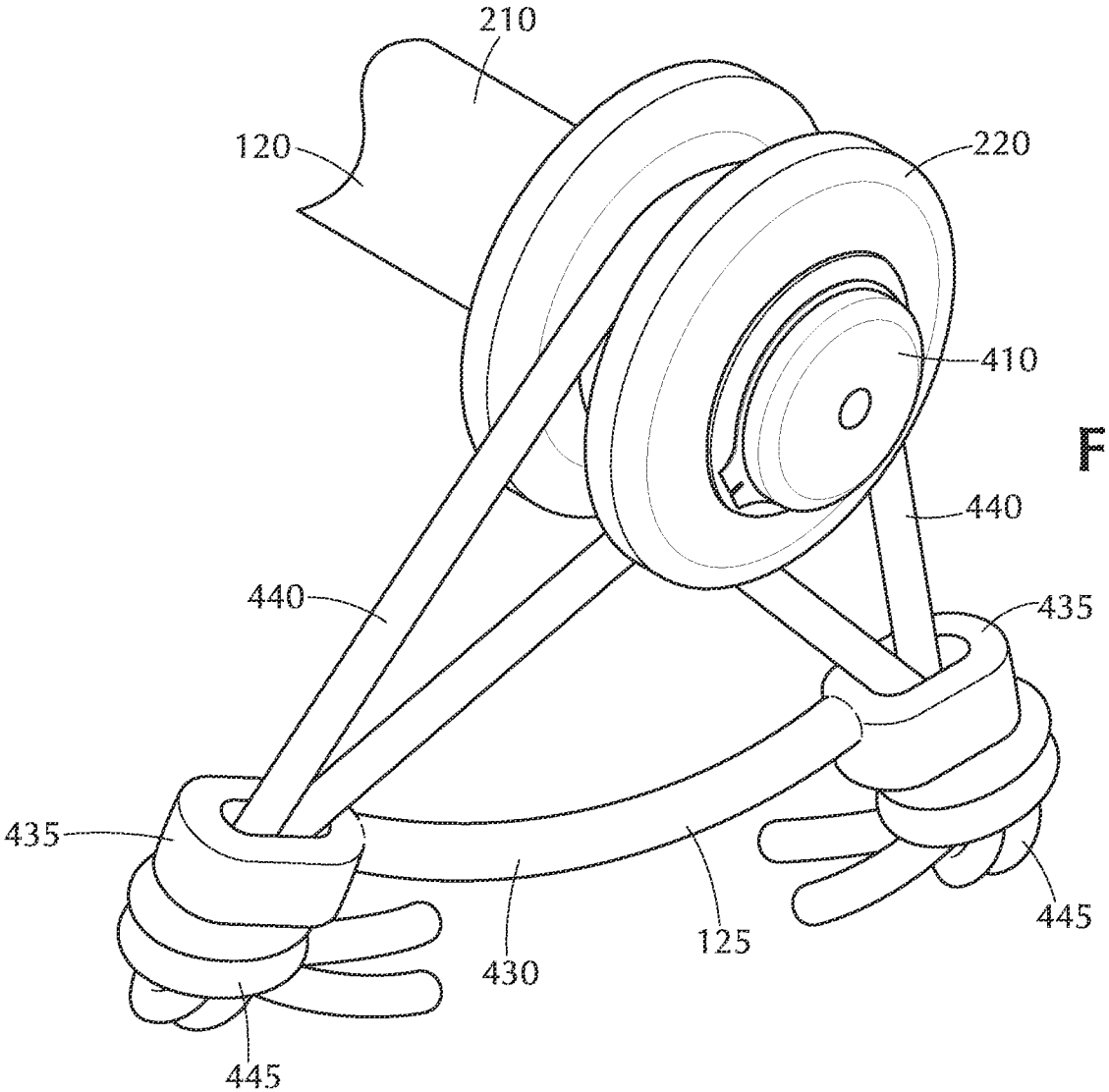
FIG. 4 depicts in detail an end of a weight bar supporting a sling according to an embodiment of the invention.

In embodiments of the invention, a weight bar 120 may have pulley hubs 220 at or near its ends, e.g., as FIG. 3 depicts. FIG. 4 depicts an end of a weight bar 120 and its pulley hub 220 in greater detail. As depicted, the pulley hub 220 is held on the end of the bar 120 by a thin cap 410 affixed to the end of the bar 120.

A structure (not pictured) may be present on the far side of the pulley hub 220 to prevent the hub 220 from traveling toward the other end of the bar 120. For example, a groove (not pictured) may be cut in the bar 120, and a retaining ring (not pictured) may rest in the groove. Alternatively, this structure may be, e.g., a flanged projection of the bar 120 or a collar affixed to the bar by adhesive or welding or merely held in place by friction. (Any groove or projection or collar used to retain the pulley hub 220 may be disregarded in determining whether the cross-section of the bar is substantially uniform.) In such a configuration the pulley hub 220 may or may not be free, or substantially free, to rotate around the bar.

Alternatively, the pulley hub 220 itself may be fixed permanently to the bar 120 at or near the end of the bar 120.

For the sake of balance, it may be desirable for the pulley hubs 220 to be placed as near as practical to the ends of the bar 120. It will be appreciated, however, that the pulley hubs 220 need not be precisely at the ends of the bar 120 for the bar 120 to exhibit acceptable balance while in use. A pulley hub 220 may be considered near the end of the bar 120 while still being sufficiently far from the end of the bar 120 to permit the pulley hub 220 to be safely secured to the bar 120.

Alternatively, in an embodiment of the invention (not pictured), the pulley hubs 220 may be spaced merely far enough to allow a user to hold the bar 120 securely during exercise. For example, when a dumbbell-like bar length is used, the pulley hubs may be separated by sufficient space for the bar to be gripped securely in one hand, possibly with sufficient extra margin for comfort, safety, or both. In exemplary embodiments of the invention, the inner edges of the pulley hubs 220 may be separated by a distance of, e.g., 5, 5.5, 6, 6.5, 7, 7.5, or 8 inches.

FIG. 4 also depicts a sling 125 suspended from a pulley hub 220 of a weight bar 120, according to an embodiment of the invention. As depicted, the sling 125 is an assembly that comprises an arm 430. The depicted arm 430 is curved into an arc, but in an alternative embodiment (not depicted), the arm may be substantially straight. At each end, the arm 430 terminates in a loop or opening 435. In an embodiment such as FIG. 4 depicts, a doubled cord 440 is passed through the opening 435 to serve as a connector between the sling 125 and the bar 120. The ends 445 of the cord 440 are tied together to form a knot that is too large to pass through the hole 435, and the bight of each cord 440 is threaded into the pulley hub 220.

The knots at the ends 445 of the cords 440 may be any knot that is large enough and strong enough to support the arm 430 while the apparatus is in use. In an embodiment of the invention, for example, a figure-8 knot with two strands of rope may be used: a figure-8 knot retains more of the tensile strength of the cord than many other knots that might be used, and it fails by slipping-which may give warning of impending failure-rather than by collapsing catastrophically.

Although both an arc-shaped arm and a straight arm may be acceptable according to embodiments of the invention, an arc-shaped arm 430, e.g., as FIG. 4 depicts, may have an advantage of preventing bunching of the elastic band, e.g., in the corner between the arm 430 and a cord 440. For example, in an embodiment such as FIG. 4 depicts, the arm 430 may formed as an arc with a radius of 3-4 inches.

Figure 5:
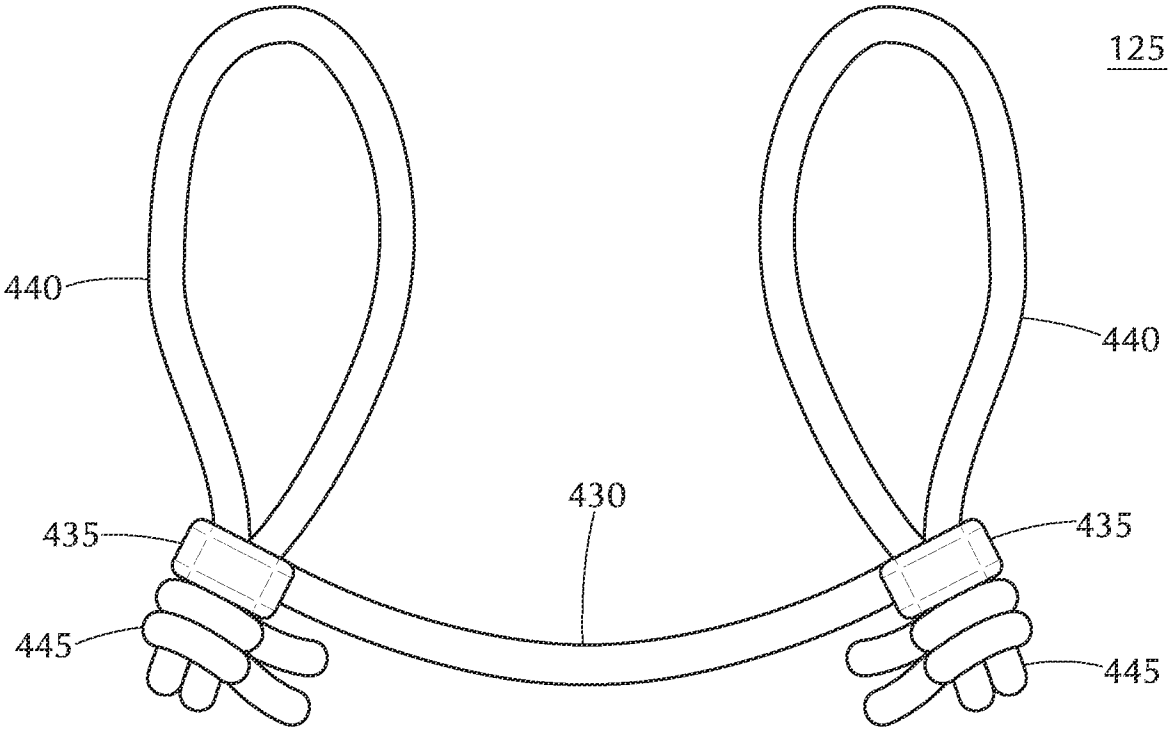
FIG. 5 depicts a sling according to an embodiment of the invention.

FIG. 5 depicts a sling 125 separated from the bar 120, according to embodiments of the invention.

In an exemplary embodiment of the invention, the pulley hubs 220 may be made of, e.g., ultra-high molecular weight (UHMW) polyethylene, and the cords 440 may be, e.g., UHMW polyethylene braided rope such as Dyneema SK78. UHMW polyethylene may be particularly well suited for this application due to its high strength, low friction, and resistance to abrasion. It will be appreciated, however, that any materials exhibiting satisfactory strength and other properties may be used.

Similarly, the arms 430 may be made of any material exhibiting sufficient strength, rigidity, and durability for the described use. In exemplary embodiments of the invention, the arms may be steel.

Further, the arms may have any dimensions consistent with the uses described in this application. In one exemplary embodiment, an arm 430 may be 6 1/16 inches long and (except at the holes 435) be ½ inch thick. The holes 435 may have any size and shape consistent with the required strength of the arm 430 and need to pass the cords 440. In some embodiments of the invention, the holes may be shaped like, e.g., ovals, ellipses, rectangles with rounded corners, or similarly. In one embodiment, intended for use with 6 mm thick cords 440, the holes may measure 8 mm by 16 mm.

Similarly, the cords 440 may be any length that is desired, and, indeed, using cords of varied lengths may allow fine-tuning of the force exerted by a particular elastic band during a particular exercise. In one embodiment, a cord may be, e.g., 5 inches from the top of the knot to the middle of the bight. Because of the bending of the cord 440 when placed over a pulley hub 220 to support the sling 220, a cord with this dimensions may support the arm at a distance of about 3 inches from the center of the bar 120. In embodiments of the invention, one or more spacers (not pictured) may be supplied for insertion between the knot and the bottom of the arm 430, effectively shortening the cord 440.

Figure 6:
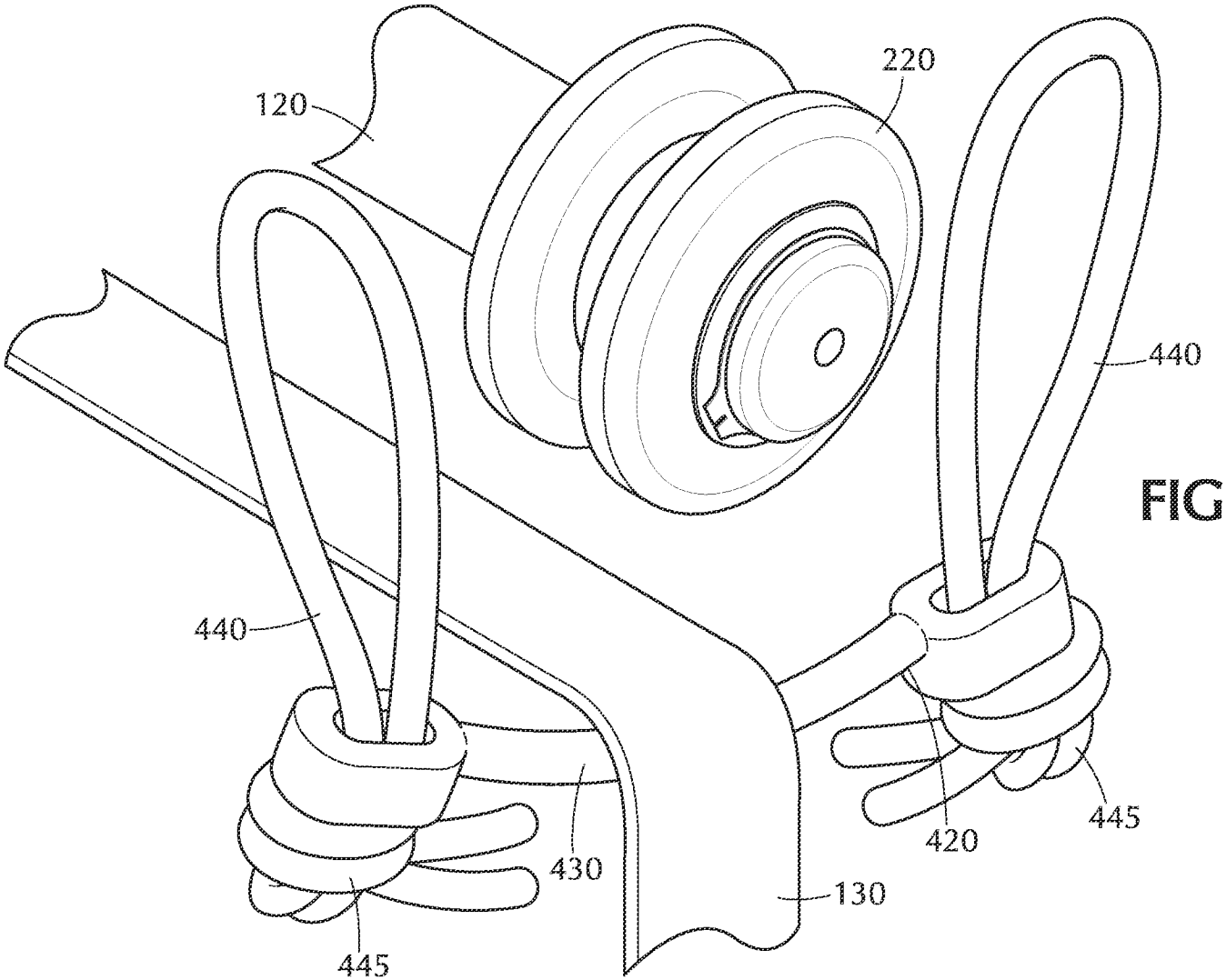
FIG. 6 depicts a weight bar, a sling, and an elastic band in connection with an embodiment of the invention.

FIG. 6 depicts the relative positions of a weight bar 120, a sling 220, and an elastic band 130 in relative positions before the sling 220 is to be suspended from the pulley hub 220. As depicted, the band 130 passes over the arm 430 of the sling assembly 125, with one of the connecting cords 440 on each side of the band 130. For exercise use, the depicted components may be assembled by slipping the bights of the cords 440 over the outer rim of the pulley hub 220, which will then keep the cords 440 in position.

Because it is supported at both ends, an arm 430 as part of a sling assembly 125, according to embodiments of the invention, may be effectively stronger than a hook of the same weight. This may in turn allow an arm 430 to support a band over more of its length than a comparable hook. As a consequence, an arm 430 such as depicted may lead to less bunching of a band, and therefore less friction and less wear on the band, than a comparable hook. For similar reasons, an arm 430 such as depicted may permit stacking-which is to say, using more than one band at a time—to achieve a greater range of resistances with a set of fewer bands.

In embodiments of the invention, an optional base plate (or, equivalently, a platform plate, foot plate, or footplate) may support a user with the elastic band, e.g., running singly or doubled through the base plate. Alternatively, if a plate is not used, in connection with embodiments of the invention, a user may, e.g., stand on the bands directly. It will be appreciated that use of a base plate as described may be preferable in connection with exercises using high loads.

Other variants are possible. For example, in embodiments of the invention, a platform (not pictured) with hooks on its upper and/or (if the platform is raised) lower surfaces may anchor the bands during exercise. The user may, e.g., stand on the platform, pressing it against the floor while moving the bar to stretch the band during the exercise. As another example, a door anchor may be used to anchor one or more bands during an exercise.

Figure 7:
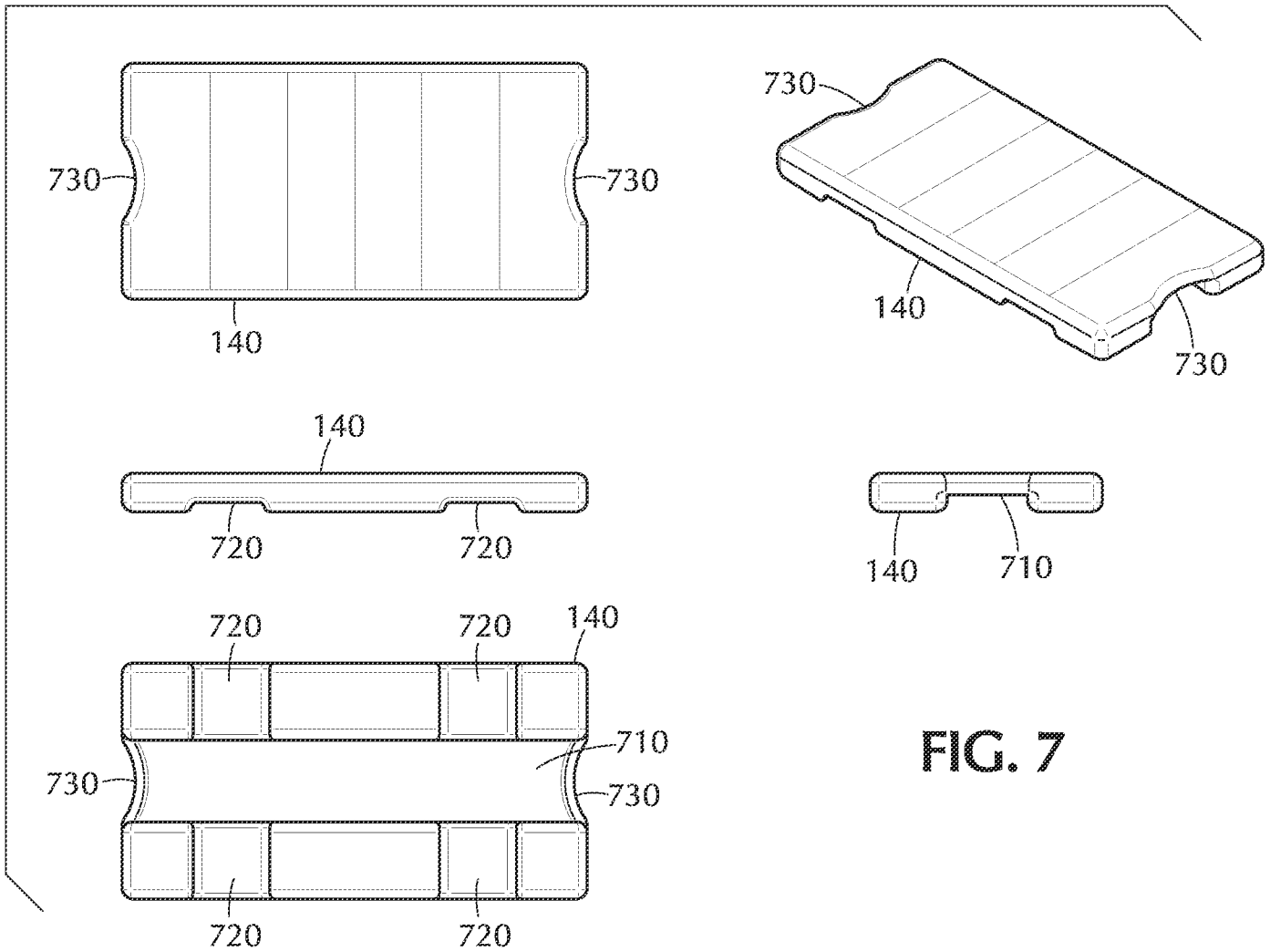
FIG. 7 depicts a footplate according to an embodiment of the invention.
Figure 8:
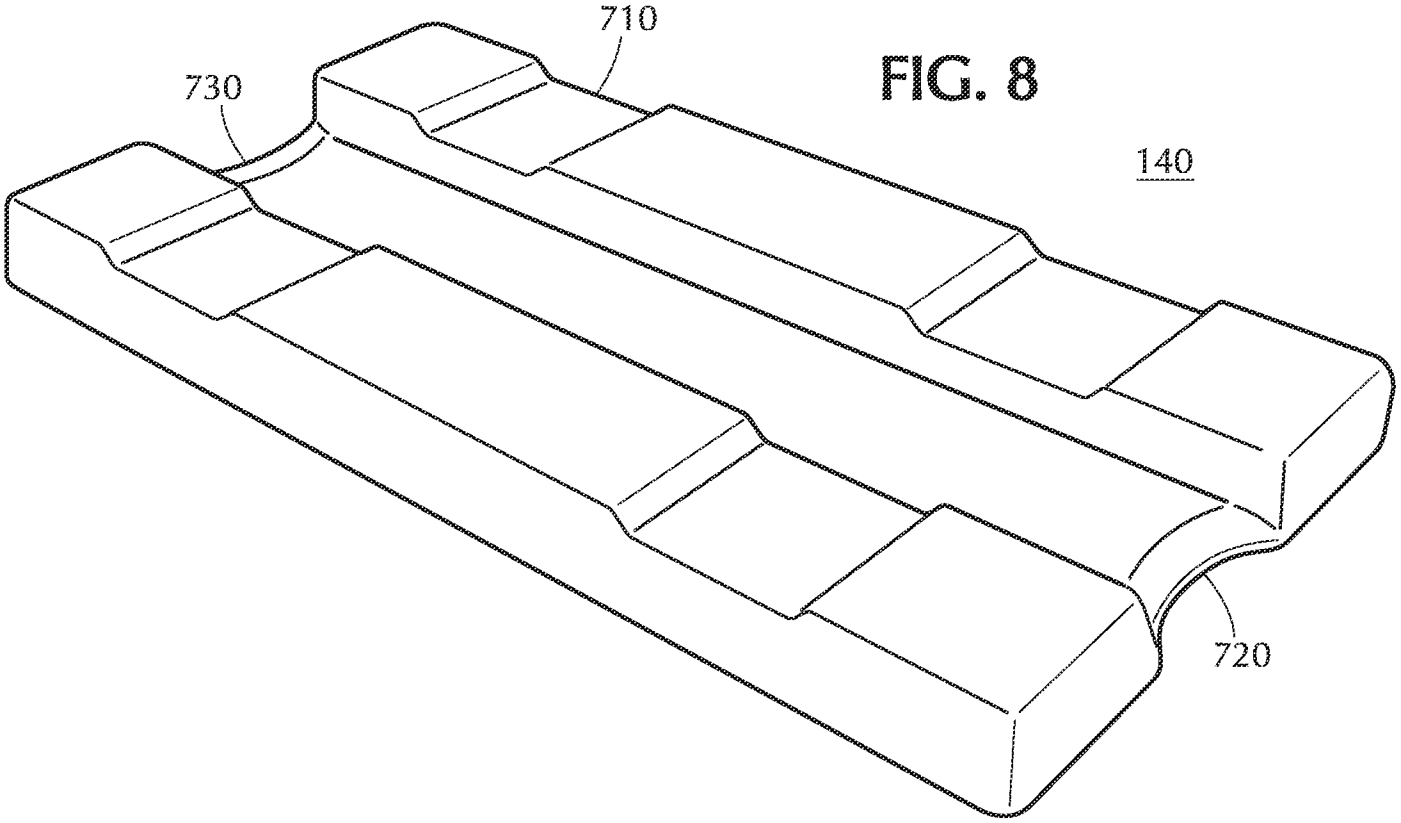
FIG. 8 depicts a footplate according to an embodiment of the invention.

FIGS. 7 and 8 depict multiple views of a footplate 140 according to an embodiment of the invention. The views of FIG. 7 include views of the depicted footplate 140 from above (a), one side (b), below (c), end-on (d), and in perspective from above (e). The figures depict an example footplate 140 with an upper surface that is 23.99 inches ×12.00 inches and that is 2.00 inches high. (Unless explicitly stated otherwise, no dimension of the depicted footplate, given in this disclosure, is critical; in embodiments of the invention, a footplate 140 and any component of a footplate may have any dimension or dimensions consistent with its intended functions.)

The footplate 140 as depicted comprises multiple channels 710, 720 to constrain the position of one or more elastic bands (not pictured) while the footplate is in use. As depicted, the center channel 710 has lips 730 that are curved along a radius of 3.5 inches when viewed from above, spanning a 4.15 inch wide channel. It will be appreciated that when a band is under tension, this shape may tend to pull the band to the center, making band placement between sets more consistent.

A footplate 140 according to embodiments of the invention may be made out of any material, and through any process of manufacture, consistent with the intended function of the footplate 140. In one exemplary embodiment, a footplate 140 may be made of UHMW polyethylene, and the surface may be polished, e.g., to a 500-1000 grit finish. This polishing, or a similar surface treatment, may reduce the surface friction of a band against the UHMW of the footplate 140, which may improve the smooth travel of latex bands along the surface.

In an embodiment of the invention, the lip 730 may project beyond the surface of the center channel 710. This configuration may, e.g., reduce the surface contact of the footplate 140 with the band, further reducing friction between the band and the footplate 140.

Returning to FIG. 1, it depicts a bar 120, elastic band 130, and footplate 140, according to an embodiment of the invention, being used for resistance training. In the depicted configuration, the band is "singled", which is to say that only one thickness of the band 130 passes under the footplate 140. As depicted, when a band is singled, another thickness of the band 130 is suspended directly under the bar 120. For many exercises, a band may be "doubled" (not pictured), with both thicknesses passing under the footplate 140. It will be appreciated that doubling the band causes the band to stretch more for a given movement than it does in a singled configuration, thereby increasing the resistance for that exercise.

As depicted, a thickness of the band 130 passes underneath a footplate 140, but use of a footplate 140 may be optional in embodiments of the invention. For example, a variant of the exercise that FIG. 1 depicts may be performed by passing a singled or doubled band beneath directly beneath either or both of the user's feet. As another example, a chest press may be performed with a singled or doubled band passing behind the user's back, again, without use of a footplate 140.

Other objects may be used with a bar, slings, footplate and elastic band or bands according to embodiments of the invention. For example, for a bench press exercise, a yoga block or other object (not pictured) may be used to prop up one end of a footplate 140. The user may lie down, resting the upper body against the floorplate 140 with the head at the raised end. If the singled or doubled band 130 passes under the raised end of the floorplate 140, the user may experience a greater range of motion while doing the exercise than would be experienced if the user were to lie flat on the floor.

Many resistance exercises may be performed with an apparatus according to embodiments of the invention as described herein. A non-limiting use of examples may include bench press, close-grip bench press, overhead press, tricep extension, deadlift, bent over rows, curls, Ferro curls, shrugs, front squat, back squat, split squats, calf raises, hack squats (aka reverse deadlifts), trap deadlifts (with two dumbbell-like bars, or "handles"), Arnold curls (with one handle and one footplate), and one-arm dumbbell row (with handle and footplate).

The invention claimed is:

1. An apparatus for use in resistance training, comprising:

an elongated bar;

a first pulley hub disposed near a first end of the bar and fixed permanently to the bar;

a second pulley hub disposed near a second end of the bar and fixed permanently to the bar, the second end being opposed to the first end; and two slings, each sling comprising an arm and two connectors extending from a respective end of the arm and terminating in a loop such that, for each sling, the two loops can be retained by one of the pulley hubs in a manner such that the sling is capable of supporting a resistance band during resistance exercise using the bar.

2. The apparatus of claim 1, wherein each arm is a bar having two ends, each end having a hole passing through the bar in a transverse direction.

3. The apparatus of claim 2, wherein each arm is substantially straight.

4. The apparatus of claim 2, wherein each arm is in the shape of an arc.

5. The apparatus of claim 2, wherein each connector is a flexible cord.

6. The apparatus of claim 5, wherein each connector is a flexible cord having its ends knotted together forming a bight in the cord such that the bight can pass through one of the holes in one of the arms but the knot cannot.

7. The apparatus of claim 1, comprising an elastic resistance band.

8. The apparatus of claim 7, comprising a footplate, the footplate having an upper side and a lower side opposed to the upper side, the lower side having one or more channels for retaining a resistance band.

* * * * *